United States Patent [19]

LePage et al.

[11] 3,984,041

[45] Oct. 5, 1976

[54] PLIER-LIKE SETTING TOOL FOR HEAVY-DUTY GROMMETS

[75] Inventors: Gerard Thomas LePage, Waterbury; Douglas Edward Sweeney, Middlebury, both of Conn.

[73] Assignee: Scovill Manufacturing Company, Waterbury, Conn.

[22] Filed: Aug. 5, 1975

[21] Appl. No.: 602,026

[52] U.S. Cl. ..... 227/76; 227/144

[51] Int. Cl.[2] ..... A41H 37/04

[58] Field of Search ..... 227/15, 58, 59, 76, 227/144; 30/364

[56] References Cited

UNITED STATES PATENTS

| | | | |
|---|---|---|---|
| 626,722 | 6/1899 | Pusey | 227/144 |
| 734,157 | 7/1903 | Bernard | 30/364 |
| 1,139,938 | 5/1915 | Weinstein | 227/144 |
| 2,445,761 | 7/1948 | Castle | 227/15 |
| 3,250,450 | 5/1966 | LePage et al. | 227/144 |
| 3,874,578 | 4/1975 | Derr et al. | 227/144 |
| 3,923,229 | 12/1975 | Kruger | 227/144 |

*Primary Examiner*—Granville Y. Custer, Jr.
*Attorney, Agent, or Firm*—Dallett Hoopes

[57] ABSTRACT

Plier-like grommet-setting tool has integral pyramidal punch and annular fabric cutter on one jaw and turntable on opposite jaw. Turntable presents two zones, one for cutting a hole in the fabric with the use of the cutter, and the other for setting the grommet eyelet with the use of the punch. Turntable may be readily shifted to present the proper zone under the punch. The tool is especially adapted for setting heavy-duty eyelets and grommets.

5 Claims, 8 Drawing Figures

PLIER-LIKE SETTING TOOL FOR HEAVY-DUTY GROMMETS

BACKGROUND OF THE INVENTION

1. Field of the Invention

This invention relates to a grommet-setting tool. More specifically, the invention relates to a plier-like tool in which plural successive operations may be performed in the process of setting a grommet, the operations including a cutting of the fabric or other sheet material onto which the grommet is to be applied and the rolling of the eyelet comprising the grommet.

2. Description of the Prior Art

A prior tool designed to set eyelets is disclosed in U.S. Pat. No. 3,250,450 to LePage, granted May 10, 1966. While meritorious, the earlier device is not particularly suitable in the setting of heavy-duty eyelets and grommets.

SUMMARY OF THE INVENTION

Briefly, the invention is a plier-like grommet-setting tool having a pair of opposing jaws and including on one jaw a pyramidal punch capable of setting heavy eyelets and having at its distal end an annular cutter, and on the other jaw a turntable having one working zone adapted to hold the eyelet, and another zone serving as an impingement surface for the cutter. The zones may be selectively aligned under the punch.

BRIEF DESCRIPTION OF THE DRAWINGS

A non-limiting embodiment of the invention is disclosed in FIGS. 1 through 6, and further features of the invention will be apparent from a reading of the following specification including references to the drawings. In the drawings.

DESCRIPTION OF THE PREFERRED EMBODIMENT

Figures 1, 1A, 1B, 2, 3, 4, 5, 6:
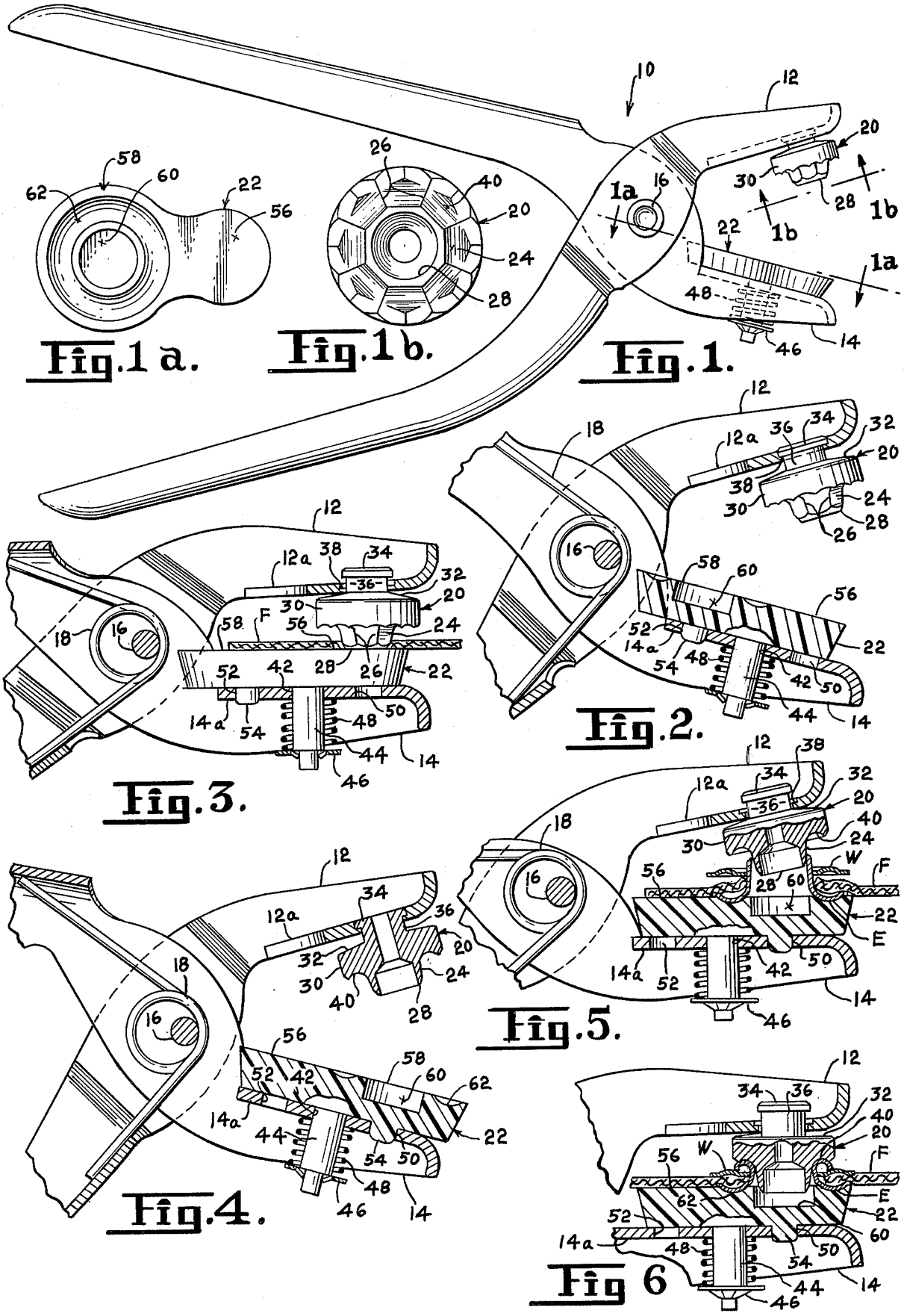
FIG. 1 is a side view of a tool embodying the invention.
FIG. 1*a* is an enlarged sectional view showing the top of the turntable and taken generally on the lines 1*a*—1*a* of FIG. 1.
FIG. 1*b* is an enlarged sectional view taken on the line 1*b*—1*b* of FIG. 1.
FIG. 2 is an enlarged side view showing the turntable and jaws partly in section.
FIG. 3 is comparable to FIG. 2 but showing the tool cutting a hole in fabric for installation of a grommet.
FIG. 4 is comparable to FIG. 2 but showing the turntable registered so that the eyelet holding means are aligned with the punch.
FIGS. 5 and 6 are similar to FIG. 4 but showing the tool in operation in successive stages during the rolling of an eyelet installing it in sheet material.

An embodiment of the invention is shown in FIG. 1 and generally designated 10. It comprises a plier-like tool having a pair of handles terminating in jaws 12 and 14, respectively, and pivoted by a conventional pin at 16. Spring means 18 (FIG. 2) may bias the jaws towards open position. Preferably, the jaws and handles are respectively integrally formed of metal stampings and providing relatively flat opposing walls 12*a* and 14*a*, respectively.

To the one jaw 12 is attached a pyramidal punch 20 and to the other jaw 14 is attached a turntable 22.

As shown best in FIG. 2, the punch 20 is of hardened metal and has a pyramidal slitting and spreading surface 24 comprising planar surfaces meeting in cutting edges 26, the shape of the pyramid tapering as the distal end of the punch is approached. The distal end of the punch is formed into an annular cutter 28.

The entire punch has an enlarged integral base 30 with a bevelled shoulder 32 leading to an attaching head 34 having a reduced neck 36. As shown, the wall 12*a* of the one jaw 12 is formed with an opening loosely receiving the neck 36 of the punch 20. The head 34 keeps the punch from falling out of the jaw and may rest, as shown, in a stepped shelf 38 in the hole. This means of connection permits, as will be noted, the slight lateral and even cocking movement of the punch with respect to the wall 12*a* so that the punch can work squarely with the eyelet parts despite the movement of the jaws in radial fashion about the pin 16.

As shown in FIG. 1*b*, the pyramidal portion 24 is surrounded at its base by an annular trough 40 which is used in rolling the split eyelet barrel.

The other jaw 14 is formed in its surface 14*a* with an opening 42 and the turntable 22 is formed with a downward boss 44 or hub which extends through the hole 42, permitting easy rotation of the turntable. The boss 44 adjacent its outer end is reduced and receives a press-on retaining washer or clip 46. Intermediate the clip 46 and the underside of the wall14*a* is a spring 48.

On the opposite sides of the opening 42, the wall 14*a* is formed with holes 50, 52, respectively. A downward nib 54 is formed at the bottom of a turntable in a position to be received into the holes 50, 52, selectively, so that with the jaws open the turntable can be raised against the force of the spring 48, turned with respect to the jaw 14 and moved into its alternate working position as the nib 54 is received selectively into the holes 50, 52. In thus setting the position of the turntable, the working zones on the top of the turntable will be brought into alignment and registration with the punch as desired.

Referring more specifically to the structure of the turntable, the working surface is divided into two zones, one zone designated 56 offers a flat impingement surface for use in cooperation with the annular cutter 28 to cut a hole in the fabric F (FIG. 3) into which the grommet is to be placed. The other working zone 58 comprises a central recess 60 (FIG. 1*a*) which receives (FIG. 6) the end of the punch upon completion of the eyelet rolling step. Concentric with the circular recess 60 is the annular depression 62 which receives the flange end of the eyelet (FIG. 5). The turntable is of a tough plastic such as nylon.

The use of the tool disclosed will be more fully understood after the following explanation. In operation and with the turntable 22 arranged so that the working surface 56 is under the punch 20 as in FIG. 3, the fabric F is perforated by cutter 28 working against fabric supported on surface 56. As shown, the bevelled surface 32 of the punch 20 permits the slight cocking of the punch with respect to the jaw 12 so that the cutter 28 can press against the fabric uniformly about its circumference against the fabric F. This is true irrespective of the thickness of the fabric F. A hole for the grommet is thereby formed in the fabric F.

With the jaws open and the fabric removed, the platform 22 is then shifted as described so that the working area 58 is aligned with the punch 20 (FIG. 4). It will be seen that the nib 54 fits in the opening 50 to effect the proper alignment of the recess 60. Next, with the eyelet E (FIG. 5) having its barrel disposed in the opening made in fabric F by the cut in the FIG. 3 step and a washer W superposing the eyelet barrel on the top of the fabric, the jaw 12 is brought down by squeezing the plier handles. This causes the pyramidal end of the punch 22 to enter into the end of the barrel, the edges 26 thereof (FIG. 2) splitting the barrel longitudinally and permitting the trough 40 (FIG. 6) to roll the split ends of the eyelet barrel over into engagement with the washer W as the jaws are brought together.

It will be seen that the distal end of the pyramidal punch enters into the recess 60 and that the annular depression 62 holds the eyelet E in position. After the jaws 12 and 14 are opened, the finished product may be removed. The product presents a smooth appearance with the flange of the eyelet E on one side of the fabric F (FIG. 6) and the washer W on the other side, the end of the eyelet barrel being crimped against the washer W, as shown.

The simple structure disclosed permits, in easy fashion, the perforation of the fabric and the application of a heavy-duty eyelet. The simple steps involved are readily accomplished, and because of the pyramidal punch, a minimum of strength is required to effect the eyelet rolling operation.

While one embodiment of the invention only has been disclosed, the coverage is to be limited only to the extent of the following claim language or equivalents thereof.

We claim:

1. A plier-like grommet-setting tool having a pair of opposing swinging jaws and including: a pyramidal punch attached to one of the jaws facing the other jaw and having planar inclined sides with eyelet barrel-cutting edges at the juncture of adjacent sides, the punch narrowing as its distal end is approached, the base of the punch being surrounded by an annular eyelet-rolling trough also facing the other jaw, the punch having an annular cutter at the distal end thereof, the cutter facing the said other jaw; a turntable of tough plastic pivotally attached to the said other jaw, the turntable having a substantially planar surface facing said one jaw, the surface having separate working zones, which may be selectively brought into alignment with the punch by rotating the turntable when the jaws are open, one of the zones being flat and adapted to serve as impingement surface for the annular cutter when the jaws are closed with fabric inbetween, the other of the zones having a recess adapted to accommodate at least part of the punch, and an annular depression surrounding the recess for holding the flange of an eyelet during the rolling of the eyelet barrel by the punch.

2. A plier-like grommet-setting tool as claimed in claim 1 wherein the punch is attached to said one jaw by mounting means permitting limited lateral and cocking movement of the punch with respect to the one jaw.

3. A plier-like grommet-setting tool as claimed in claim 1 wherein the turntable is attached to the said other jaw by a hub passing through an opening in the said other jaw.

4. A plier-like grommet-setting tool as claimed in claim 3 wherein the said other jaw has a pair of holes respectively on opposite sides of the opening respectively and the turntable has a downward nib spaced from the hub so that the zones may be selectively registered with the punch as the nib is received into the holes respectively.

5. A plier-like grommet setting tool having a pair of opposing swinging jaws and including on one jaw a pyramidal punch having an annular cutter at its smaller distal end and on the other jaw a plastic turntable having working zones, one zone having indented means to hold an eyelet flange while the eyelet barrel is being rolled by the punch, and the other zone having flat impingement means adapted to work with the cutter when the jaws are closed on a piece of fabric, the zones being selectively alignable under the punch by rotation of the turntable.

* * * * *